US005359661A

United States Patent [19]

Manlove et al.

[11] Patent Number: 5,359,661

[45] Date of Patent: Oct. 25, 1994

[54] OUT-OF-LOCK DETECTOR FOR SYNCHRONOUS AM DETECTION

[75] Inventors: Gregory J. Manlove; Detlef Griessman; Richard A. Kennedy, all of Kokomo; Thomas G. Block, Carmel, all of Ind.

[73] Assignee: Delco Electronics Corporation, Kokomo, Ind.

[21] Appl. No.: 954,997

[22] Filed: Oct. 1, 1992

[51] Int. Cl.[5] ..... H04H 5/00

[52] U.S. Cl. ..... 381/15; 381/13; 331/DIG. 2

[58] Field of Search ..... 381/15, 13; 455/265, 455/266; 329/306, 360; 331/DIG. 2

[56] References Cited

U.S. PATENT DOCUMENTS 3,932,821 1/1976 McClaskey ..... 331/25
4,377,728 3/1983 Hilbert ..... 179/1
4,691,175 9/1987 Ecklund ..... 381/15
4,747,141 5/1988 Kahn ..... 381/15
4,845,750 7/1989 Ecklund et al. ..... 381/15
5,014,316 5/1991 Marrah et al. ..... 381/15
5,023,909 6/1991 Kahn ..... 381/15

*Primary Examiner*—Curtis Kuntz
*Assistant Examiner*—Mark D. Kelly
*Attorney, Agent, or Firm*—Anthony Luke Simon; Jimmy L. Funke

[57] ABSTRACT

An AM stereo receiver in which a synchronous in-phase signal is determined comprises a low pass filter circuit for determining an average DC value of the synchronous in-phase signal, a reference voltage supply for providing a reference voltage indicative of a predetermined portion of the DC value of the synchronous in-phase signal occurring during a 100% IF signal level condition, a comparison circuit for comparing the average DC value of the synchronous in-phase signal to the predetermined reference, and an output circuit outputting a signal indicative of an out-of-lock condition when the average DC value of the synchronous in-phase signal falls below the predetermined reference.

2 Claims, 7 Drawing Sheets

OUT-OF-LOCK DETECTOR FOR SYNCHRONOUS AM DETECTION

The subject of this invention is related to the subject of U.S. Pat. application, Ser. No. 07/954,721, entitled "AM Stereo Detection and Audio Processing Apparatus," filed concurrently with this application, assigned to the assignee of this invention and the disclosure of which is incorporated herein by reference; this invention is also related to the subject of U.S. Pat. No. 5,151,939; filed Mar. 21, 1990, and to the subject of U.S. Pat. No. 5,014,316, both assigned to the assignee of this invention and having disclosures of which are incorporated herein by reference.

This invention relates to AM radio signal detection, and more particularly to synchronous AM radio detection.

BACKGROUND OF THE INVENTION

Synchronous AM detection has distinct advantages over non-synchronous detection due to improved signal-to-noise performance under poor signal conditions. Synchronous AM detection requires a reliable out-of-lock detector to provide high quality AM reception.

Referring to FIG. 1, a standard AM receiver that decodes C-QUAM (Compatible Quadrature Amplitude Modulation) is shown. The receiver shown in FIG. 1 is described in U.S. Pat. Nos. 5,014,316 and 5,151,939, referred to above.

In the standard receiver shown in FIG. 1, an input signal is received at antenna 210, converted to an IF signal in front end circuit 212 and amplified by the IF amplifier 214. AM stereo decoder 256 receives the signal from IF amplifier 214, comprising the signal that was modulated in C-QUAM at the AM stereo broadcaster and which must now be decoded. Envelope detector 216 receives the amplified IF signal and outputs a signal, E, on line 12 comprising 1+L+R, where L represents the left channel signal and R represents the right channel signal of the AM stereo signal.

The amplified IF signal is also input to variable gain amplifier 219, whose gain is controlled by the output amplifier 217 (explained below). The output of gain circuit 219 is coupled to in-phase detector 218 and quadrature phase detector (QDET) 220. QDET 220 acts as the phase detector for the phase lock loop 226. The output of QDET 220 is coupled to loop filter 224 in phase lock loop 226, continuing through the +1/−1 gain block 320. The output of loop filter 224 is coupled to voltage controlled oscillator (VCO) 222.

In-phase detector (IDET) 218 and QDET 220 are synchronous detectors and receive in-phase (0°) and quadrature (90°) inputs respectively from VCO 222. Without the signal correction, the output signals from IDET 218 and QDET 220 would be (1+L+R) cosine ($\theta$) and (L-R) cosine ($\theta$), labeled I (synchronously detected in-phase signal) and Q (synchronously detected quadrature-phase signal) on lines 14 and 16 respectively.

The output I of the IDET 218 goes through gain block 318, described below, and is coupled to the input of amplifier 217, which amplifies the difference between the output I on line 14 and the output E on line 12 and provides that amplified difference to variable gain amplifier 219. This feedback circuit forces the corrected I output on line 14 to be equal to the E output of 1+L+R on line 12, forcing the gain of gain stage 219 to equal 1/ cosine ($\theta$). Since the output of variable gain stage 219 is also coupled to QDET 220, this forces the output Q on line 16 to be equal to L-R.

The outputs I and Q of IDET 218 and QDET 220 are input to matrix and audio processing circuitry 233, where base band audio left and right signals are produced. Circuitry 233 is discussed in detail in U.S. Pat. No. 5,151,939, referred to above, and is not set forth in further detail herein, as it is not central to the present invention.

Frequency detector 319 and +1/−1 gain blocks 318 and 320 help phase lock loop 226 quickly lock onto AM signals. The frequency detector 319 looks at the output of IDET 218 at the zero crossings of the output signal Q of QDET 220. If the output of IDET 218 is positive at the zero crossings of the signal Q, both of the +1/−1 gain blocks 318, 320 invert the I and Q signals output from IDET 218 and QDET 220. If the signal I is negative with respect to AC ground at the zero crossings of the signal Q, the +1/−1 gain blocks do not invert the I and Q signals output from IDET 218 and QDET 220.

Referring to FIG. 2, the signals E, I and Q during the lock condition are shown assuming no modulation. The lock condition occurs when VCO 222 matches the output frequency and phase of IF amplifier 214. FIG. 2 shows the signal I, 20, matching the signal E, 18, and the DC average of the Q signal 22 equivalent to AC ground 24. In this condition, the net DC voltage input to VCO 222 remains unchanged and phase lock loop 226 stays locked.

FIG. 3 shows the signal Q, 28, and the signal I, 26, during an out-of-lock condition when the frequency of VCO 222 is higher than the output frequency of IF amplifier 214. In this condition, the +1/−1 gain blocks 318 and 320 are functioning and the I and Q signals are inverted 180° when the signal I is positive at the zero crossing of the signal Q. The DC average of the signal Q now pulls the VCO frequency lower to lock phase lock loop 226 to the input IF signal.

FIG. 4 illustrates the signals Q, 32, and I, 30, during an out-of-lock condition when the output signal of VCO 222 is lower in frequency than the output frequency of IF amplifier 214. Again, in this example the gain blocks 318 and 320 are functioning and the DC average of the Q signal pulls the VCO 222 frequency higher to lock phase lock loop 226 to the input IF signal. The wave forms 26, 28, 30 and 32 in FIGS. 3 and 4 represent invalid I and Q signals that would yield noisy audio signals, which are objectionable to the listener.

Referring to FIG. 5, a prior art implementation of an out-of-lock detector is shown using frequency detector 319, which outputs a lock signal on line 34. In the prior art frequency detector, a lock condition is ideally indicated by a 0 signal on line 34, which occurs when the average Q equals the AC ground. Likewise, an out of lock condition is ideally indicated by a 1 signal on line 34. However, there is not a 100% correlation between a 0 output on line 34 and the lock condition of phase lock loop 226.

One example of non-correlation between the signal on line 34 and the lock state of phase lock loop 226 happens during the occurrence of an AM co-channel condition, which is likely to occur in AM when the broadcaster range of radio stations is greatly extended, such as night time. A typical co-channel condition occurs when two radio stations at the same location of the AM radio dial, but different broadcast locations, are being received. For example, assume that the undesired signal is six decibels weaker than the desired signal at the radio antenna. The carrier of the undesired signal would then tend to beat with the desired signal at a very low frequency rate on the order of 1–5 Hz. This creates 6 dB beat in the carrier of the desired signal at a beat frequency rate equal to the difference between the frequency of the two carriers (1–5 Hz). If a desired signal hits 100% modulation peaks at a 6 dB null of the carrier, excess in the signal I occurs or an equivalently positive signal is output from frequency detector 319 at the zero crossings of the Q signal. This condition creates excess I modulation with peaks of modulation reaching 200%, which is the same as 100% excess I modulation. The result is flagged by frequency detector 319 as an out-of-lock condition by an output of a 1 on line 34 when the AM stereo decoder actually has not lost lock. The 1 signal on line 34 throws the receiver into an out-of-lock signal processing mode, resulting in noise transients that listeners find objectionable due to gain blocks 318,320 instantaneously flipping the I and Q signals.

Another example in which the lock signal on line 34 does not correlate with the actual lock state occurs when the IF level is dramatically decreased due to weak AM reception conditions. The extremely low level of the IF signal greatly reduces the amplitudes of the I and Q signals so that the I and Q signals are too small to overcome the offsets in the logic circuitry of frequency detector 319. This prevents frequency detector 319 from signaling an out-of-lock condition, if one exists. Since the AM detector does not, in this instance, signal the occurrence of an out-of-lock condition, the appropriate audio processing necessary to eliminate noise caused by the out-of-lock condition cannot be initiated in the synchronous detector.

In FIG. 5, block 180 is an amplifier used as an excess I signal detector to also indicate an out-of-lock condition. Excess I detector 180 indicates an out-of-lock condition by providing a 1 signal on line 36, which is OR'd with the signal on line 34 at gate 190 to provide the out-of-lock signal on line 38. Excess I detector 180 is well known to those skilled in the art.

The inputs to excess I detector 180 are the signal I at the non-inverting input and a 188% DC reference signal at the inverting input. Normally, the signal I rides on a net DC voltage equal to 0 and should never go positive during normal lock conditions. When excess I is present, the I dignal may go above 0 volts.

While the reference voltage at the inverting input at block 180 may be set to any percentage, when set to 188% modulation or 88% of excess I, the reference is set at an absolute value of 88% of the DC average voltage of the I signal during an in-lock condition of a 100% IF signal level added to the AC ground. If at any time the instantaneous I level goes beyond the reference level, excess I comparator 180 trips and therefore trips the OR gate 190, which outputs an out-of-lock signal. An example of how the excess I detector works may be understood with reference to FIGS. 6*a–e*.

In FIGS. 6*–e*, trace 40 represents signal I characterized as generally below AC ground. AC ground is generally set at a positive DC reference due to the nature of integrated circuitry. Trace 42 represents the sample signal Q. Trace 44 represents an ideal lock signal and trace 46 represents a filtered I signal run through a 10 Hz low pass filter. The DC average of signal I is set equal to −318 millivolts with respect to the AC ground. The absolute value of 88% of the −318 millivolts is equal to 280 millivolts. Therefore, the reference of the excess I comparator is set equal to 280 millivolts. The excess I detector fails to output an out-of-lock signal corresponding to a natural out-of-lock condition as follows.

For modulation percentages, up to and including 100%, excess I modulation is 0. When the modulation goes beyond 100%, excess I can result. During an excess I condition, the output of the IDET 218 goes positive with respect to the AC ground, instead of staying negative as during a non-excess I condition. This can be an indication of an out-of-lock condition, or this can result from the co-channel condition previously described. The co-channel condition previously mentioned was a condition for which phased lock loop 226 is capable of staying locked but during which excess I was generated. Thus, the appearance of excess I, which is consistently flagged by excess I detector 180, is not necessarily an indication of an out-of-lock condition.

During weak AM reception conditions, an out-of-lock condition could occur and not be flagged by the excess I detector. The amplitudes of the detected I would be greatly reduced due to the weak IF signal level. The reference for the excess I comparator is based on a fixed DC reference that corresponds to a nominal IF level. The low level IF signal generates an excess I percentage unchanged from the strong AM reception condition, but with a low peak magnitude resulting from the lower IF signal level. Therefore, the excess I detected at the input of excess I detector 180 is not sufficient to trip the excess I flag and indicate out-of-lock on line 38.

The above examples are four conditions in which the out-of-lock detector shown in FIG. 5 provides an output that does not correspond with the two state-of-lock conditions of phase lock loop 226. In two of the conditions, occurring during co-channel situations, both frequency detector 319 and excess I detector 180 generate false out-of-lock flags. In the two conditions described illustrating weak IF levels, both frequency detector 319 and excess I detector 180 did not generate an out-of-lock flag when one should have been flagged.

FIG. 6*e* shows the out-of-lock signal 48 for the circuit shown in FIG. 5, illustrating the false out-of-lock condition between times $t_0$ and $t_1$ while failing to illustrate the out-of-lock condition between times $t_2$ and $t_3$.

Summary of the Invention

This invention provides an AM stereo decoder with a new out-of-lock detector that signals more reliable out-of-lock flags for synchronous detection of AM signals.

Advantageously, the out-of-lock detector of this invention is capable of signaling an out-of-lock condition during weak AM reception conditions.

Advantageously, the out-of-lock detector of this invention is capable of signaling in-lock conditions and out-of-lock conditions in synchronous detectors with an improved high degree of correspondences to actual in-lock and out-of-lock conditions.

Advantageously, the apparatus of this invention does not provide an out-of-lock flag when the phase lock loop remains locked and the received signal has occasional noise.

Advantageously, the apparatus of this invention provides a new out-of-lock detector that compares the average DC value of the synchronously detected I signal to a predetermined DC threshold and accurately generating an out-of-lock flag when the average DC value of the I signal drops below this threshold.

In an advantageous structure to achieve the above recited advantages, this invention comprises an AM stereo decoder, means for determining the average DC value of the synchronously detected I signal, means for providing a reference voltage, means for comparing the average DC value of the synchronously detected I signal to the reference voltage and means for signaling an out-of-lock condition when the average DC value of the synchronously detected I signal is less than the reference voltage.

In accordance with the advantages described above, the method of this invention comprises the steps of a) generating a synchronously detected I signal; b) determining an average DC value of the synchronously detected I signal; c) generating a fixed reference signal; e) comparing the DC value of the synchronously detected I signal to the fixed reference; and e) outputting a lock flag indicating an out-of-lock condition when the average DC value of the synchronously detected I signal is less than the fixed reference.

A more detailed description of this invention, along with various examples thereof, are set forth below.

DETAILED DESCRIPTION OF THE INVENTION

Figure 1:
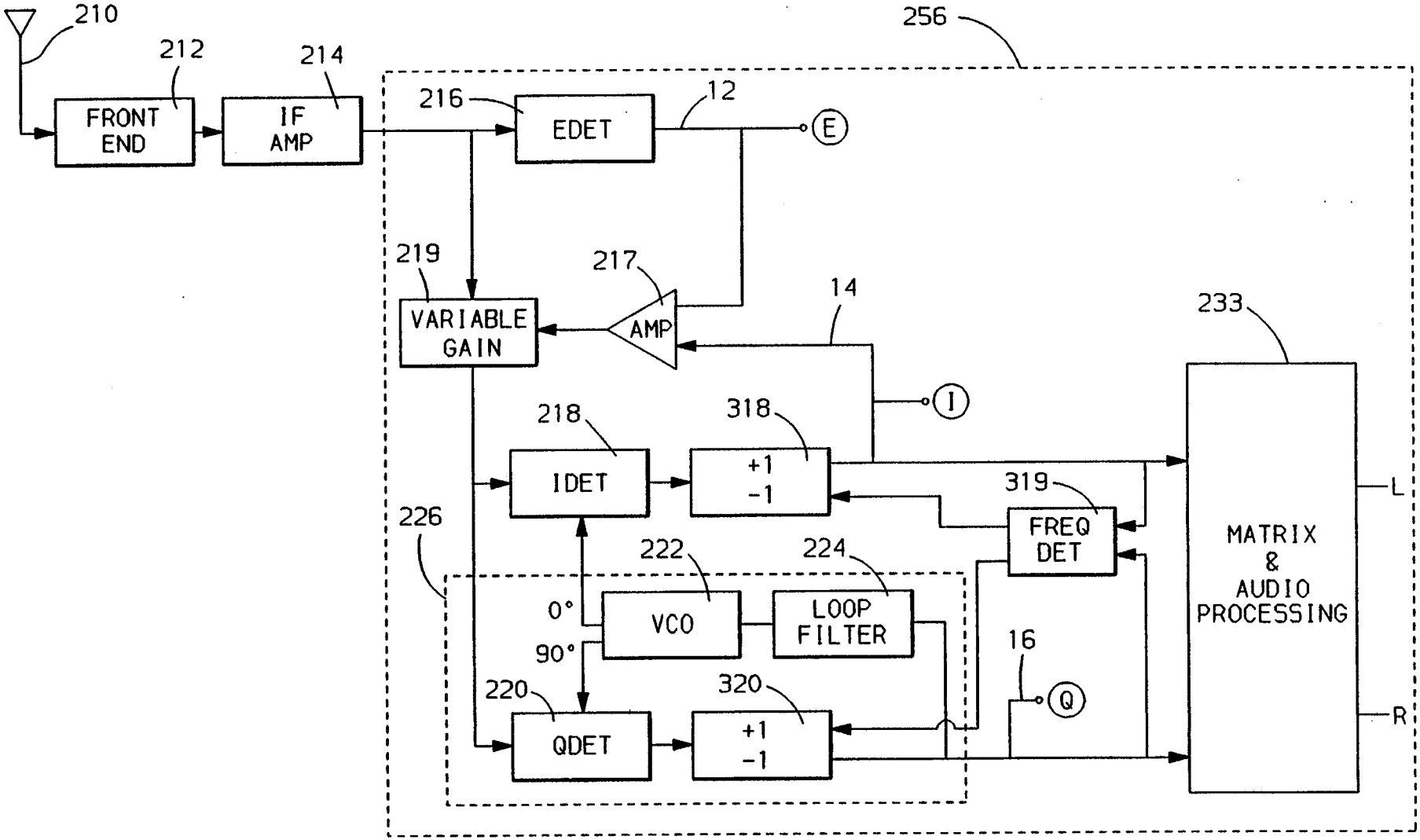
FIG. 1 is a block diagram of a typical prior art AM stereo receiver.
Figure 2A:
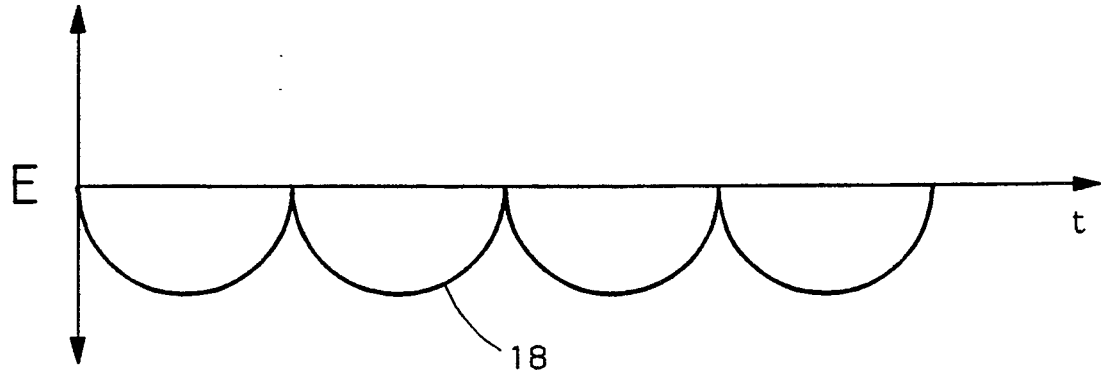
FIGS. 2, 3 and 4 are diagrams illustrating signal characteristics of in phase and quadrature phase detected AM signals.
Figure 2B:
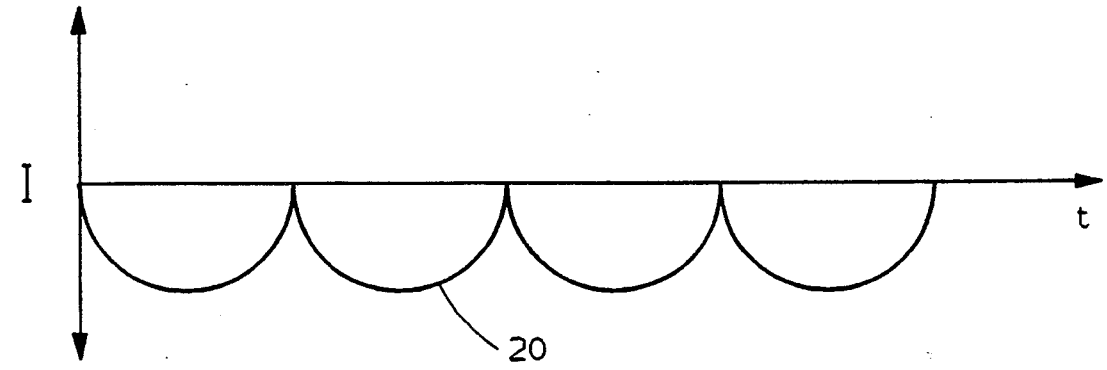
Figure 2C:
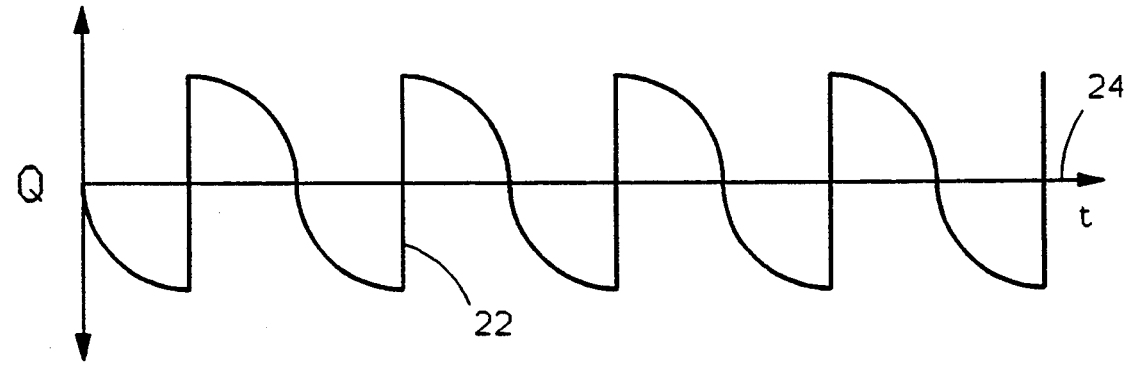
Figure 3A:
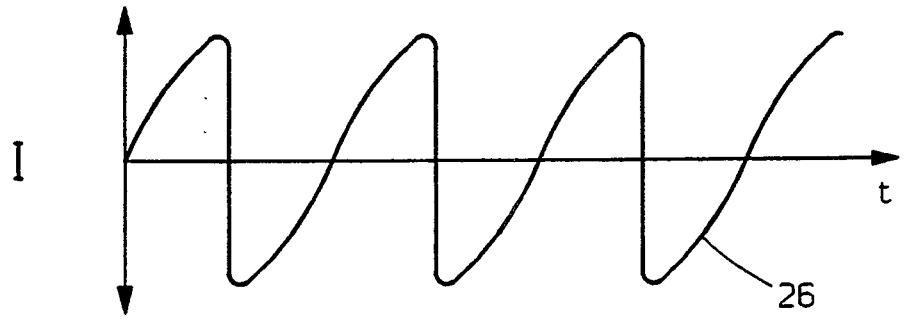
Figure 3B:
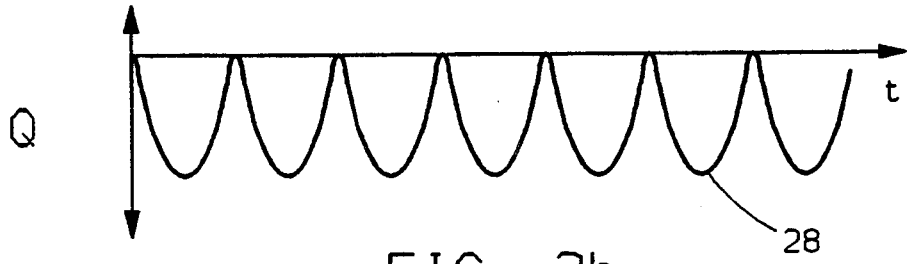
Figure 4A:
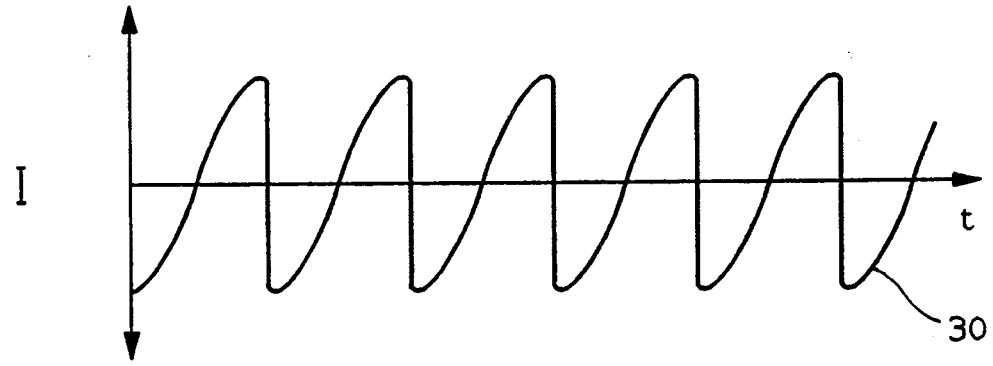
Figure 4B:
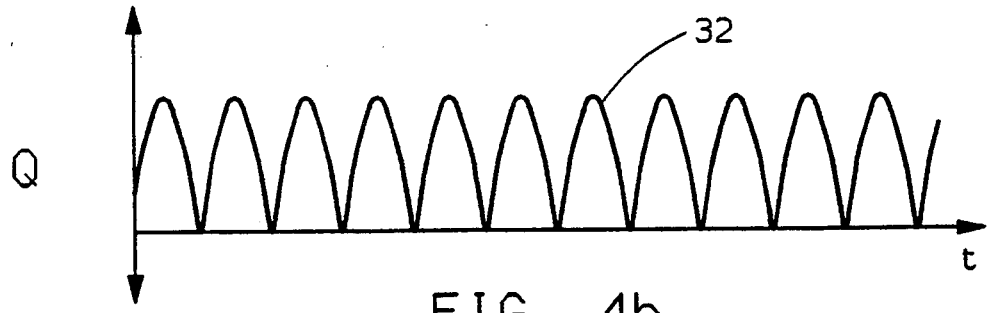
Figure 5:
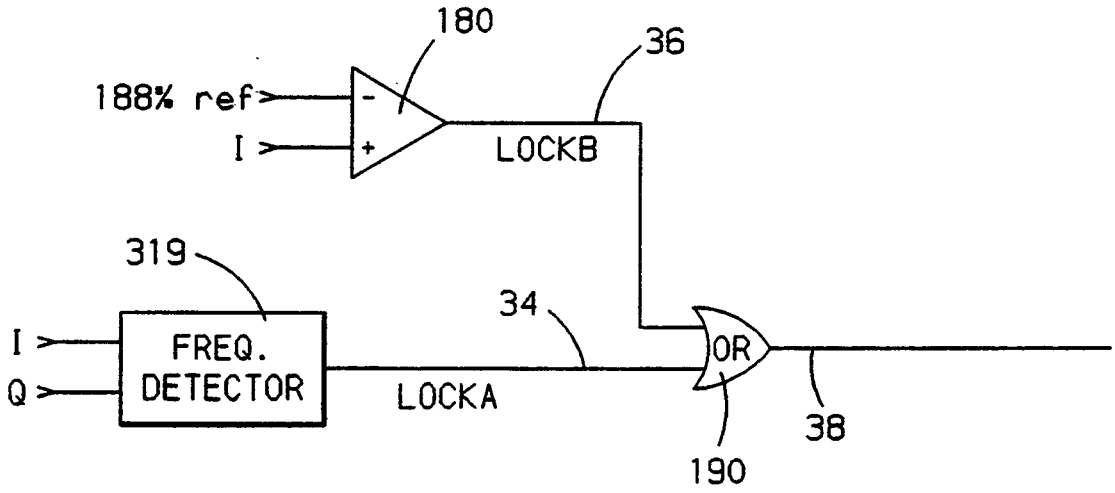
PRIOR ART FIG. 5
FIG. 5 illustrates a prior art out-of-lock detector.
Figure 7:
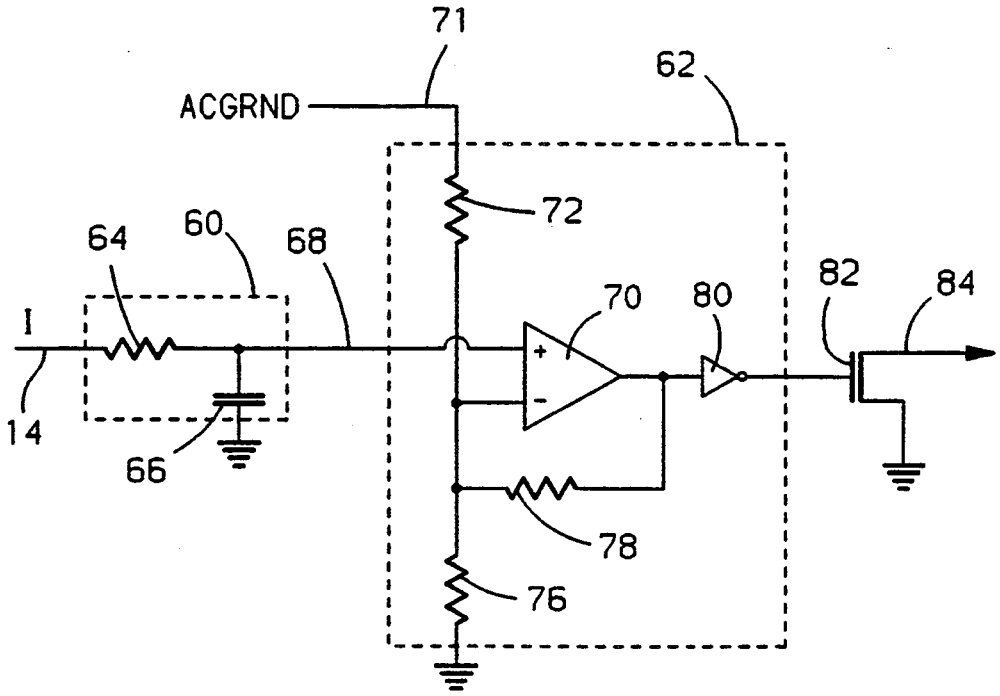
FIG. 7 illustrates the apparatus of this invention.

Referring to FIG. 7, the synchronously detected in-phase signal I on line 14 from IDET 218 is provided to means 60 for generating a DC level signal indicative of the average DC value of the synchronously detected I signal. The means 60 comprises a low pass filter preferably set with a pole at 10 Hz and may include, for example, resistor 64 and capacitor 66. Capacitor 66 is an external capacitor because size constraints generally prohibit its fabrication onto the integrated circuit. The output of the low pass filter on line 68 is the DC value of the average synchronously detected in-phase signal I and corresponds to the signal trace 46 in FIG. 6*d*.

Line 68 is coupled to means 62 for comparing the DC value of the synchronously detected I signal to a fixed reference voltage. The fixed reference voltage is set up by a resistor divider comprising resistors 72 and 76 coupled between ground at an internal reference voltage supply at line 71, i.e., set equal to AC ground, which is typically one half the supply voltage level.

With resistor 78 in the feedback of comparator 70, the comparison circuit has hysteresis with comparator 70 turning off at a lower point than it turns on. Preferably, comparator 70 is set so that the DC off threshold occurs when the signal on line 68 falls below 15% of the normal signal level on line 68 during 100% AM carrier level condition. The DC on threshold is preferably set to 30% of the 100% AM carrier level. Those skilled in the art can easily set the DC "off" and "on" points with the values of resistors 72, 76 and 78 and may vary the percentage levels of the "off" and "on" points as particular implementation constraints require or as desired. The low threshold is set to assure that noise or offsets in the circuitry do not keep the circuit from detecting an out of lock condition. The difference between the low threshold and the high threshold is set as a function of desired immunity to repeated switching between lock and out-of-lock signal processing.

When the DC level of the signal on line 68 falls below 15% of the 100% level, the out-of-lock flag at the output of comparator 70 goes high indicating an out-of-lock condition. The hysteresis is provided to prevent a series of trips in the out-of-lock flag from being generated when the DC level is close to the reference level.

The output of comparator 70 is inverted by inverter 80, which is input to the base of transistor 82, which in turn pulls the signal level of line 84 to 0 during an out-of-lock condition. The signal on line 84 can then be used to control the AM stereo receiver for signal processing during an out-of-lock condition.

The out-of-lock detector shown on FIG. 7 does not generate the false out-of-lock flag described with reference to the prior art above and does not indicate a lock condition when the IF signal is too weak to lock, therefore providing an out-of-lock detector with improved accuracy. Additionally, the out-of-lock detector is insensitive to AC transients of the modulation and generates an out-of-lock flag when the average DC value of the carrier goes to zero.

Figure 6A:
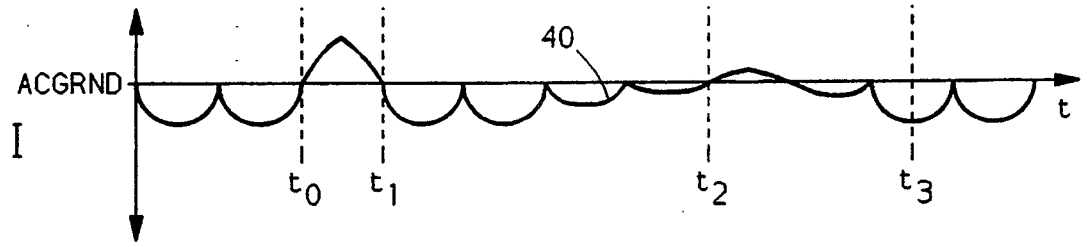
FIGS. 6*a–e* illustrate example signals in an AM stereo decoder.
Figure 6B:
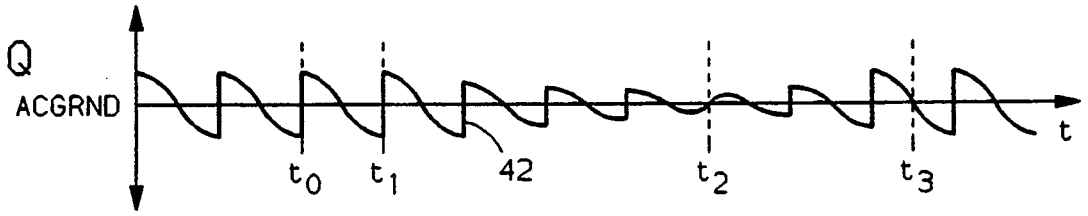
Figure 6C:
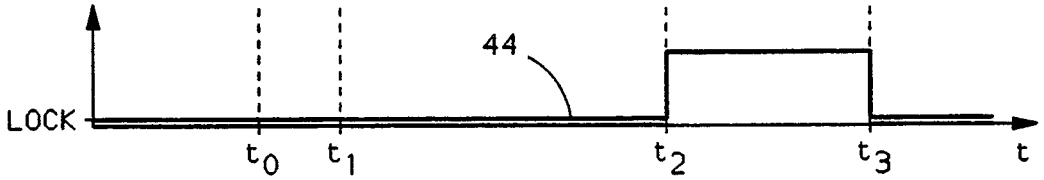
Figure 6D:
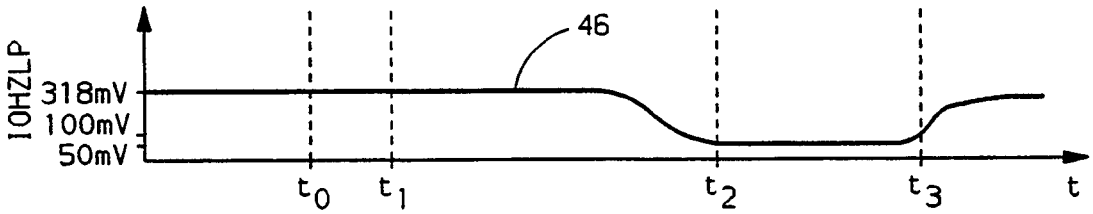
Figure 6E:
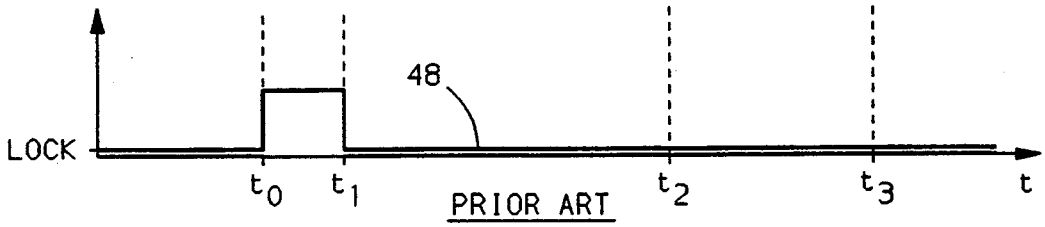
PRIOR ART FIG. 6e

FIG. 6*c*, trace 44 shows the hysteresis effect of the out-of-lock detector, sending an out-of-lock signal when trace 46, FIG. 6*d*, falls below 50 millivolts at time $t_2$ and ending the out-of-lock signal when trace 46 rises above the 100 millivolt level at time $t_3$.

Figure 8:
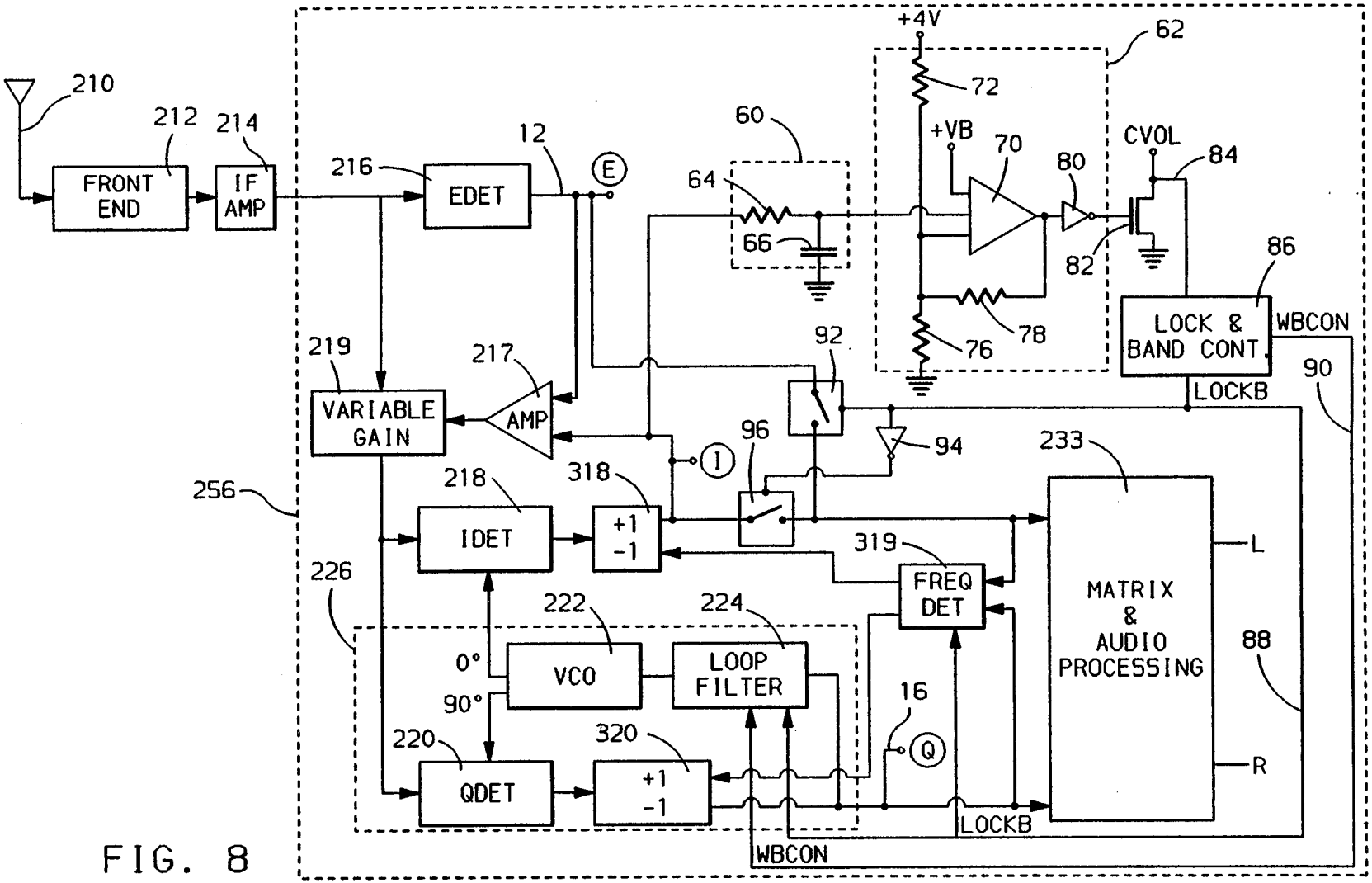
FIG. 8 illustrates an AM stereo decoder implementing the apparatus of this invention.

Referring to FIG. 8, implementation of the out-of-lock detector of this invention into the AM stereo decoder is shown. Line 84 indicates an out-of-lock condition with a 0 signal that is coupled to block 86, which controls the lock and phase lock loop bandwidth control for the circuit. Block 86 is described in detail in copending U.S. patent application Ser. No. 07/954,721, referred to above.

The detailed circuitry of block 86 is not necessary for this invention, except that it includes an inverter that outputs a signal on line 88 comprising an inversion of the signal on line 84. The inverted lock signal on line 88 controls switching between the I and E signals to the matrix and audio processing circuitry 233. When phase lock loop 226 is not locked, it is desirable for the E signal to be provided to the matrix and audio processing circuitry 233 and output to the listener, while during a locked condition, it is desirable for the I signal to be provided to circuitry 233 and output to the listener.

To accomplish appropriate switching of the E and I signals, transmission gates 92 and 96 and inverter 94 are used. Transmission gates 92 and 96 and inverter 94 switch between the selection of the E and I signals to circuitry 233 in accordance with the in-lock and out-of-lock conditions signaled on line 88. The connection of the LOCKB signal on line 88 and the WBCON (band width control) signal on line 90 to the loop filter 224 and frequency detector 319 is discussed in the above-mentioned copending U.S. patent application Ser. No. 07/954,721.

Figure 9:
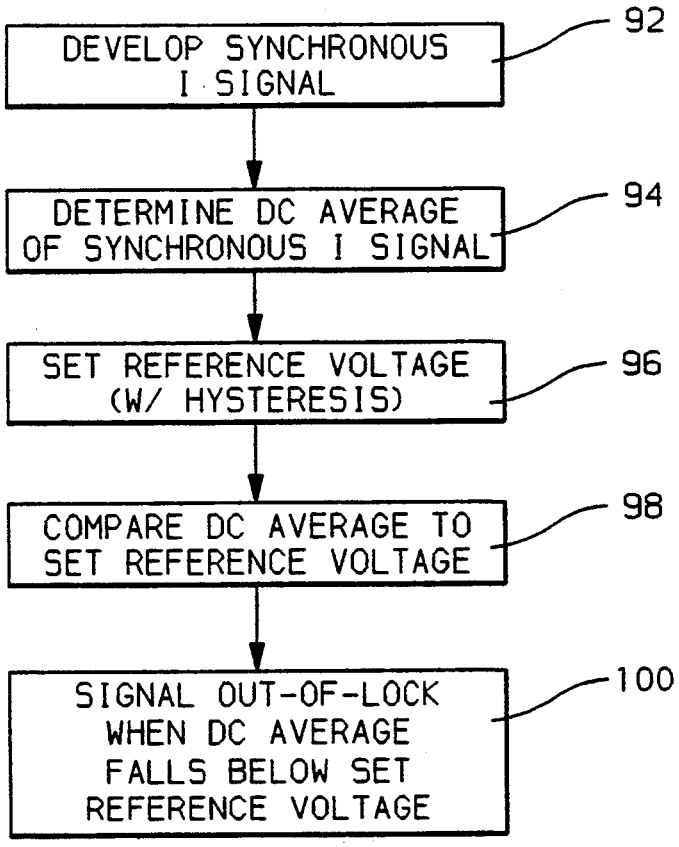
FIG. 9 illustrates a flow chart of the sequence of operations of this invention.

Referring to FIG. 9, the method of this invention is illustrated whereby the advantages recited herein are achieved through (i) development of a synchronous I signal at block 92, (ii) determining the DC average of the synchronous I signal at block 94, i.e. through the low pass filter 60 shown in FIG. 7, (iii) setting the reference voltage preferably with hysteresis (block 96) as done by the comparator 70 and resistors 72, 76 and 78 in FIG. 7, (iv) comparing the DC average to the set reference voltage at block 98, and (v) signaling an out-of-lock condition when the DC average falls below the set reference voltage, block 100. This indication corresponds to the signal output from comparator 70 and the signal on line 84 (FIG. 7).

The above described implementations of this invention are example implementations of which alternative circuit or computer implementations performing the equivalent functions are considered equivalent. Various improvements and modifications to this invention may occur to those skilled in the art and will fall within the scope of this invention as set forth below.

The embodiments of the invention in which an exclusive property or privilege is claimed are defined as follows:

1. An AM stereo decoder for processing an IF signal comprising:

means for receiving the IF signal and generating an envelope detected E signal;

means including a phase lock loop for receiving the IF signal and generating a synchronously detected in-phase I signal and a synchronously detected quadrature-phase Q signal;

means for determining an average DC value of the in-phase I signal;

means for providing a reference voltage;

means for comparing the average DC value of the in-phase I signal with the reference voltage and for providing an out-of-lock signal indicating an out-of-lock condition of the phase lock loop when the average DC value falls below the reference voltage and for providing an in-lock signal indicating an in-lock condition of the phase lock loop when the DC value rises a predetermined amount above the reference voltage;

a matrix and audio processor for generating base band audio left and right signals based upon signals applied to first and second inputs of the matrix and audio processor;

means coupling the Q signal to the second input of the matrix and audio processor; and control means for switching the I signal to the first input of the matrix and audio processor when the phase lock loop is indicated to be in the in-lock condition and for switching the E signal to the first input of the matrix and audio processor when the phase lock loop is indicated to be in the out-of-lock condition.

2. The AM stereo decoder set forth in claim 1, wherein the control means further includes means for controlling phase lock loop bandwidth based upon the in-lock and out-of-lock signals.

* * * * *